US012247409B2

(12) United States Patent
Jablonsky

(10) Patent No.: US 12,247,409 B2
(45) Date of Patent: Mar. 11, 2025

(54) LIFTING PIN ANCHOR WITH ANNULAR PLATE

(71) Applicant: ALP Supply, Inc., Fairless Hills, PA (US)

(72) Inventor: David S. Jablonsky, Washington Crossing, PA (US)

(73) Assignee: ALP Supply, Inc., Fairless Hills, PA (US)

( * ) Notice: Subject to any disclaimer, the term of this patent is extended or adjusted under 35 U.S.C. 154(b) by 215 days.

(21) Appl. No.: 18/086,002

(22) Filed: Dec. 21, 2022

(65) Prior Publication Data

US 2023/0235582 A1 Jul. 27, 2023

Related U.S. Application Data

(60) Provisional application No. 63/302,666, filed on Jan. 25, 2022.

(51) Int. Cl.
*E04G 21/14* (2006.01)

(52) U.S. Cl.
CPC ..... *E04G 21/142* (2013.01)

(58) Field of Classification Search
CPC ..... E04G 21/142; E04G 21/147; E04B 1/41; E04B 5/02
USPC ..... 52/125.4
See application file for complete search history.

(56) References Cited

U.S. PATENT DOCUMENTS

| | | | | |
|---|---|---|---|---|
| 3,499,676 | A * | 3/1970 | Haeussler | B66C 1/666 294/90 |
| 4,000,591 | A * | 1/1977 | Courtois | E04G 21/142 52/707 |
| 4,702,045 | A * | 10/1987 | Fricker | E04G 21/142 52/125.4 |
| 5,829,207 | A * | 11/1998 | Mackay Sim | E04G 21/142 52/125.4 |
| 6,233,883 | B1 * | 5/2001 | Arteon | E04G 21/142 52/707 |
| 6,260,900 | B1 * | 7/2001 | Scott | E04G 21/142 294/215 |
| 9,347,232 | B1 | 5/2016 | Francies, III | |
| 10,538,910 | B2 * | 1/2020 | Espinosa | E04B 1/4121 |
| 10,767,323 | B2 * | 9/2020 | Connell | E01C 11/005 |

(Continued)

FOREIGN PATENT DOCUMENTS

| | | | |
|---|---|---|---|
| KR | 20160111753 | A | 9/2016 |
| WO | WO2007/073108 | A1 | 6/2007 |
| WO | WO2017/139612 | A1 | 8/2017 |

OTHER PUBLICATIONS

Halfen—DEHA Spherical Head Liting Anchor System, Product Catalog p. 36. 2014.*

(Continued)

*Primary Examiner* — Paola Agudelo
(74) *Attorney, Agent, or Firm* — Dority & Manning, P.A.

(57) ABSTRACT

An anchor is provided having a lifting pin, with a shaft, a head at an upper end of the shaft, and a foot at a lower end of the shaft, and the anchor further comprising an annular plate with an opening through the center, positioned with the shaft extending through the opening and the annular plate overlaying and supported by the foot. The annular plate has an area that is at least 80% of the area of a hypothetical circle circumscribing the annular plate.

20 Claims, 4 Drawing Sheets

(56) References Cited

U.S. PATENT DOCUMENTS

| | | | | |
|---|---|---|---|---|
| 2003/0208968 | A1* | 11/2003 | Lancelot, III | E04G 21/142 52/125.4 |
| 2003/0208969 | A1* | 11/2003 | Lancelot, III | E04G 21/142 52/125.4 |
| 2005/0183349 | A1* | 8/2005 | Hansort | E04G 15/04 52/125.4 |
| 2014/0053475 | A1* | 2/2014 | Siqueiros | E04G 21/142 52/125.4 |
| 2014/0096459 | A1* | 4/2014 | Recker | E04B 1/41 52/125.5 |
| 2015/0101266 | A1* | 4/2015 | Barraclough | E04G 21/142 52/125.4 |
| 2016/0347584 | A1* | 12/2016 | Recker | E04G 21/142 |
| 2018/0023296 | A1* | 1/2018 | Recker | E04G 21/147 52/126.6 |

OTHER PUBLICATIONS

ALP Supply, Inc., Precast Accessories Catalog, Plastic Bar Supports, 2018, pp. 11-18, ALP Supply, Inc., Fairless Hills, PA, US.
Halfen, DEHA KKT Spherical Head Lifting Anchor System, Technical Product Information Catalog, 2020, pp. 8, 11.
RSteel, RLFP (Flat Plate) Lifting Anchor, Product Catalog, 2018.
Halfen, DEHA Spherical Head Lifting Anchor System, Product Catalog, 2015, p. 36.
European Search Report EP23152341 on Jun. 13, 2023.

* cited by examiner

LIFTING PIN ANCHOR WITH ANNULAR PLATE

This invention relates generally to a lifting pin or "dog bone" type anchor, which may be embedded in a precast concrete structure, to assist in lifting the concrete structure. In particular, the invention is directed to an improvement, whereby an annular plate is placed over the foot of the lifting pin, to create an anchor with increased lifting capacity.

BACKGROUND OF THE INVENTION

Lifting pin anchors, also referred to as dog bone anchors, are well known. The anchors are made of high-strength steel, with hot forged ends. The upper end or head is typically disk-shaped and extends above the concrete, in order to engage a lifting eye. The lower end or foot has a diameter greater than that of the shaft of the anchor and is embedded in the concrete, to create lifting capacity.

The forging process places practical limitations on the size of the foot of the lifting pin anchor. One prior art method used to increase the lifting capacity of the anchor is to provide a square plate, which overlays the foot of the lifting pin. The square plate has a central opening, which is large enough to allow the plate to pass over the head of the lifting pin, but small enough to prevent the square plate from passing over the foot. For example, once the lifting pin component of the anchor has been forged, the square plate is slid over the head until it rests on the foot of the lifting pin. The square plate can then be welded to the top of the foot, to maintain the desired orientation, that is, with the plate is perpendicular to the shaft of the lifting pin.

Nevertheless, there are shortcomings with the prior art approach, namely, the corners of the square plate are vulnerable to stress during lifting, due to the geometry of a "point" created by a 90° angle and the greater distance of the corner of the plate from the shaft, relative to the midpoint of the side of the plate from the shaft.

SUMMARY OF THE INVENTION

An anchor is providing having a lifting pin with a shaft, a head at the upper end of the shaft, and a foot at the lower end of the shaft. The lifting pin, in particular, the shaft, head and foot, may be formed from a single, unitary bar of metal, for example, by forging, as is known in the art. The head of the lifting pin is typically a standard shape, to allow engagement with a lifting eye. By way of example, the head may have the shape of a cylindrical disk, with the sides of the disk oriented perpendicular to the shaft. The cylindrical disk is sometimes referred to as a "spherical head" connector.

The foot may be circular, oval or other geometric shape. In one embodiment of the invention, the foot has the shape of the frustum of a cone, and the frustum is oriented with the base increasing in width from the top of the foot to the bottom of the foot. The head of the lifting pin is smaller than the foot of the lifting pin in at least one dimension, measured perpendicular to the shaft. For example, when both the head and the foot of the lifting pin have a circular cross section perpendicular to the shaft, the diameter of the head is less than the diameter of the foot.

Next, an annular plate is provided having an opening substantially through the center, perpendicular to the planar extent of the plate. The opening in the annular plate is large enough to pass over the head of the lifting pin, but small enough to prevent the annular plate from passing over the foot. After the annular plate is oriented perpendicular to the shaft, while overlaying the top of the foot, with the shaft extending through the opening, the annular plate can be welded to the foot, to maintain the proper orientation of the components, while the anchor is being embedded in a precast concrete structure. It can be understood that the annular plate is supported by the foot, when a load is applied, such as when the precast concrete structure is lifted by the anchor, and the anchor does not rely solely on the weld to transfer force from the lifting pin to the annular plate.

The anchor of the present invention, including the shaft, head, foot and annular plate, may be made of metal, such as steel. The anchor may be provided with a protective coating or finish.

The term "annular plate" is intended to include plates that have a circular shape, as well as certain elliptical shapes and convex polygonal shapes, in particular, regular polygonal shapes, provided that the area of the plate is at least 70%, in particular at least 75%, or even at least 80% of the area of a hypothetical circle circumscribing the plate. For the purposes of calculating the area of the plate, the opening in the center of the plate is included in the area. For clarification, the area of the annular plate is measured as the planar surface of the annular plate, which would be the surface perpendicular to the axis of the shaft, when the anchor is assembled.

DETAILED DESCRIPTION OF THE INVENTION

Without intending to limit the scope of the invention, the preferred embodiments and features are hereinafter set forth. All of the United States patents and published applications cited in the specification are incorporated herein by reference.

Figure 1:
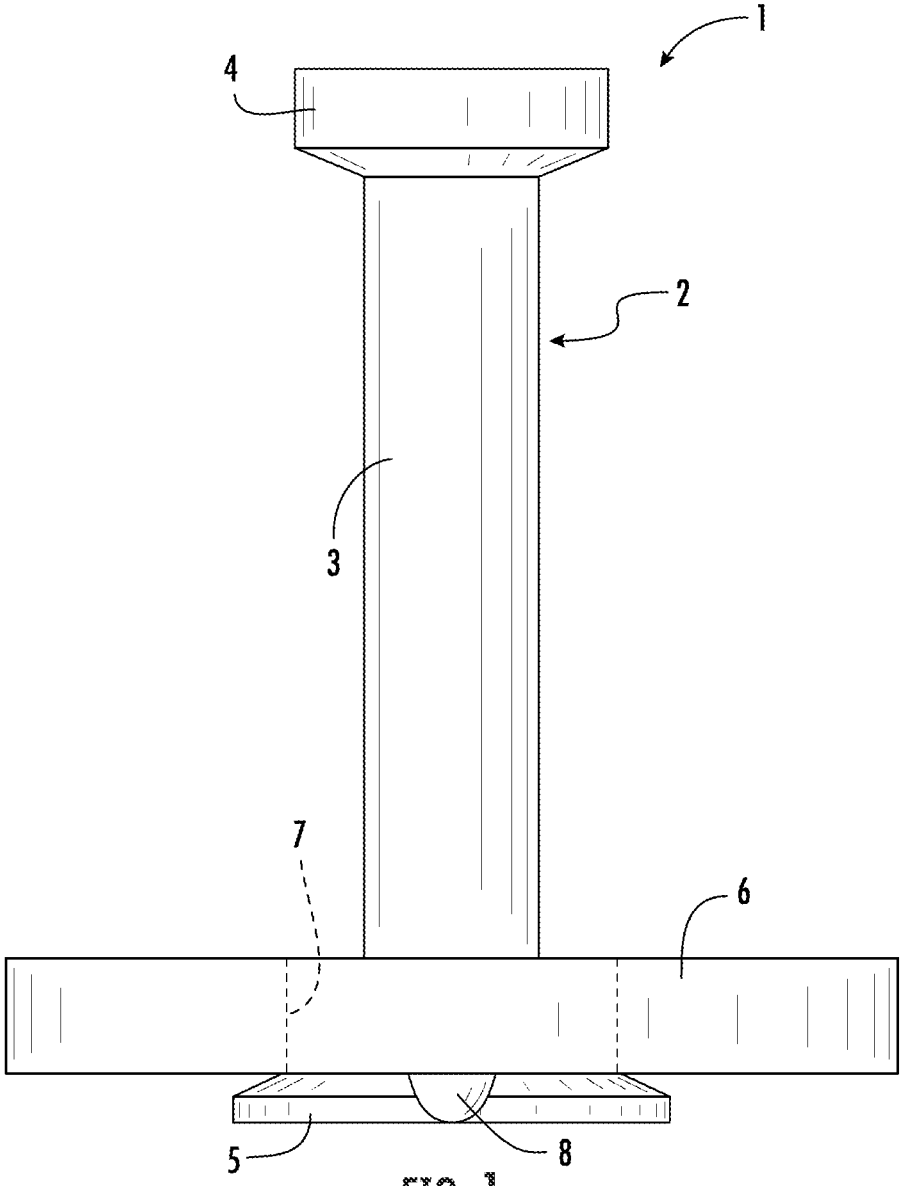
FIG. 1 is a side elevation view of the lifting pin anchor with annular plate of the present invention.
Figure 2:
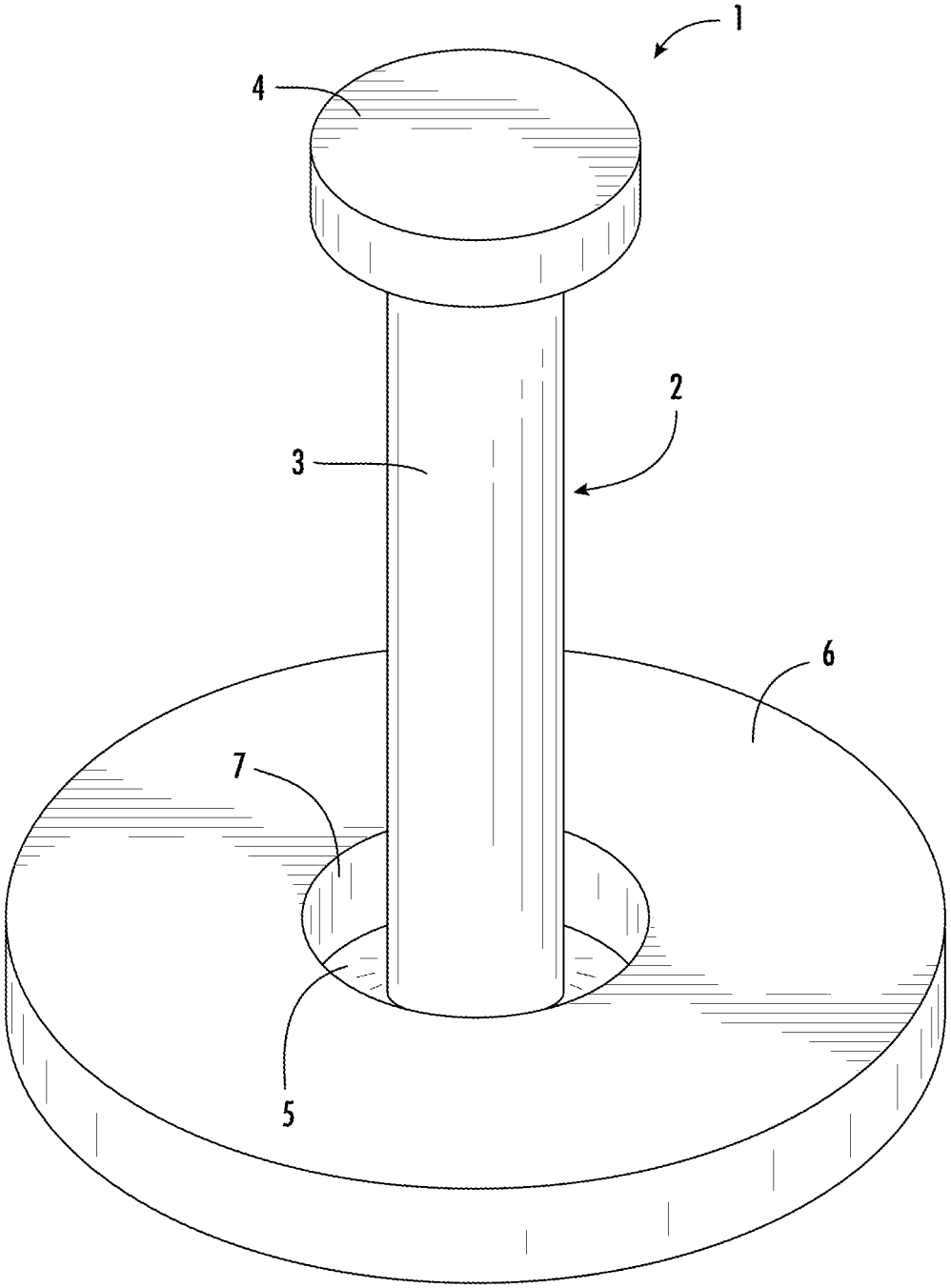
FIG. 2 is an upper perspective view of the anchor.

Referring to FIGS. 1 and 2, anchor 1 has lifting pin 2 with shaft 3, head 4 at the upper end, and foot 5 at the lower end, opposite head 4. Annular ring 6 has opening 7 in the center, which is sufficiently sized relative to head 4, to allow annular ring 6 to pass over head 4, with shaft 3 extending through opening 7. Opening 7 is sized relative to foot 5, whereby annular ring 6 is too small to pass over foot 5, but rather rests on and is supported by foot 5, with the planar extent of annular ring 6 aligned perpendicular to shaft 3. Annular ring 6 may be welded to foot 5 by one or more spot welds 8, or a continuous weld (not shown). In the example illustrated, foot 5 has the general shape of the frustum of a cone.

In one embodiment of the invention, head 4 is cylindrical in shape, with a circular cross section, and the axis of the cylinder is aligned with shaft 3. Opening 7 may also be circular, and the diameter of opening 7 is greater than the diameter of head 4. It can be understood that it may be convenient to employ a head that is not cylindrical in shape, in order to engage a certain design of lifting eye. A feature of the invention, however, is that opening 7 of annular ring 6 is able to pass over head 4, even if one or both of the shapes of head 4 and opening 7 are irregular, and even if one must be rotated relative to the other, to allow annular ring 6 to pass over head 4.

The actual dimensions of anchor 1 may vary depending on the application. By way of example, a lift anchor rated for 4 tons (8,000 lbs.) with a 4 to 1 ultimate load of 16 tons, may have an overall length of 4½", a head diameter of 1⁷⁄₁₆", a shaft diameter of ¾", and a foot diameter of 2". The annular plate may have a diameter of 4" and a thickness of ½".

FIGS. 1 and 2 illustrate the anchor of the present invention with a circular annular plate. The annular plate may have an elliptical or polygonal shape, provided that the area of the plate, including the opening, is at least 70%, in particular at least 75%, or even more particularly at least 80% of the area of a hypothetical circle circumscribing the plate. By way of example, the shape of the annular plate may be circular, elliptical, oval, or ovate, or the shape of the annular plate may be a convex polygon having five or more sides, in particular, from five to twelve sides. By way of further example, the shape of the annular plate may be a regular polygon, such as a pentagon, hexagon, heptagon, octagon, nonagon, decagon, hendecagon or dodecagon.

It is believed that providing an annular plate with an area that is large relative to a circumscribing circle allows the pull out capacity of the anchor to be maximized for a given thickness of metal. In other words, the present invention allows users to achieve a desired pull out capacity, with a minimum thickness of metal.

Figure 3:
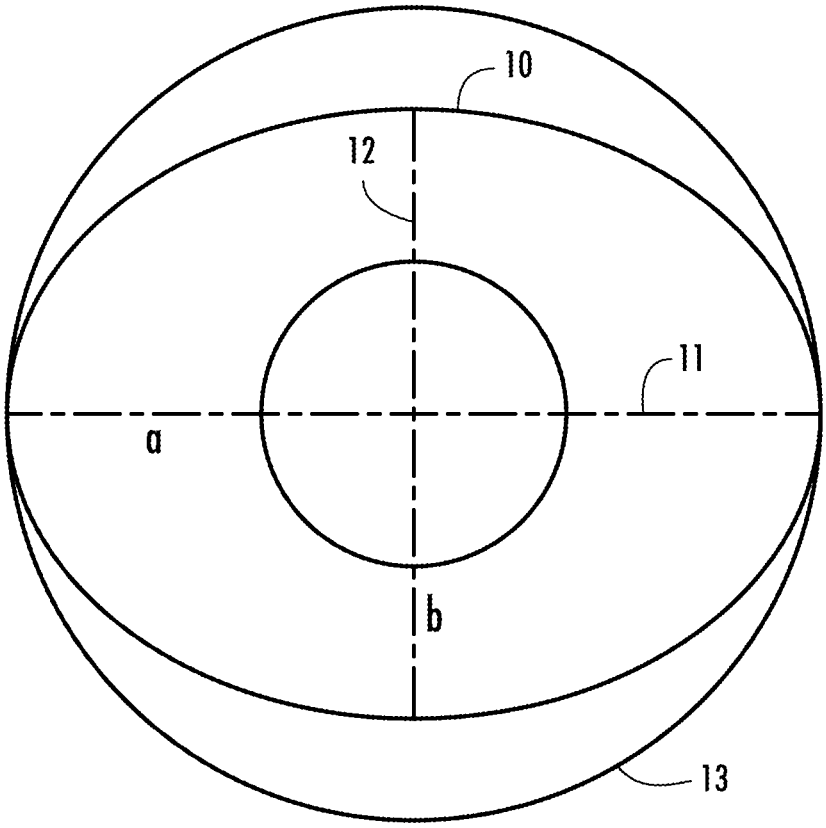
FIG. 3 is a schematic view of the face of an annular plate having an elliptical shape, and showing the annular plate with a circumscribed circle.

Referring to FIG. 3, ellipse 10 has major axis 11 and minor axis 12, and ½ of the major axis is shown as distance "a" and ½ of the minor axis is shown as distance "b." A circumscribing circle 13 has a radius of "a." The area of an ellipse ($A_{ellipse}$) is equal to $\pi ab$, and the area of a circle ($A_{circle}$) is $\pi a^2$. Accordingly, when the value of "b" is at least 70% of the value of "a," then the annular plate will have an area that is at least 70% of the circumscribing circle.

Figure 4:
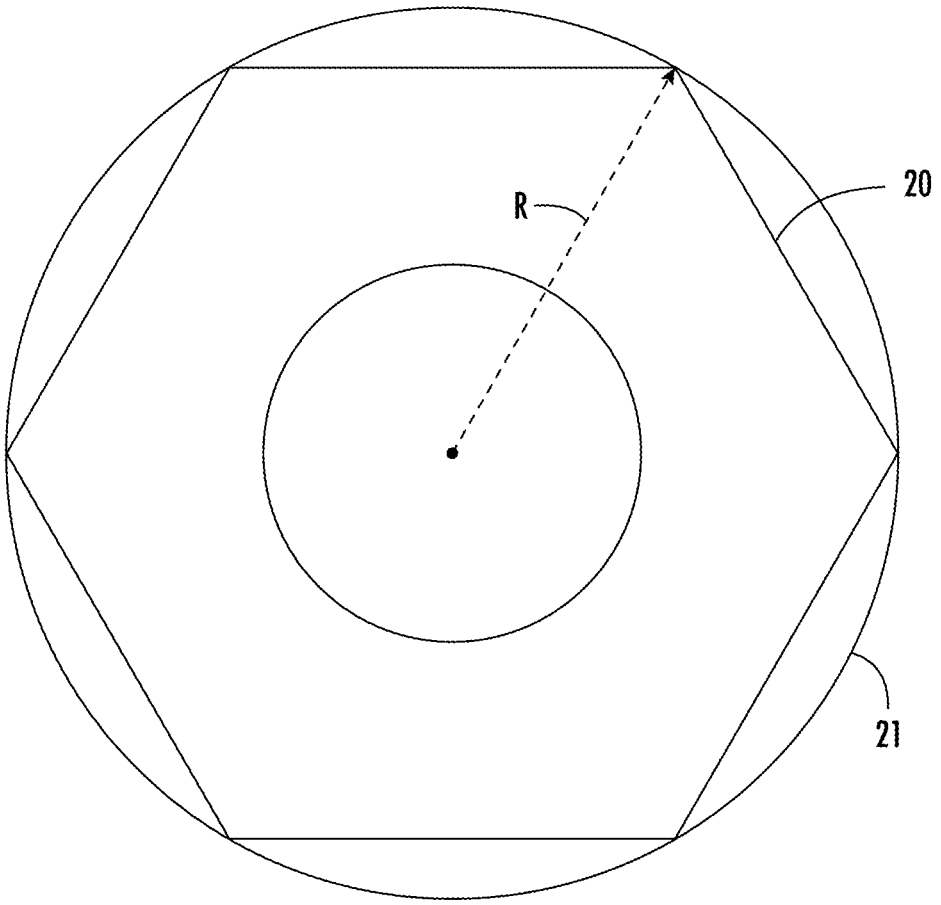
FIG. 4 is a schematic view of the face of an annular plate having a regular, hexagonal shape, and showing the annular plate with a circumscribed circle.

Referring to FIG. 4, hexagon 20 is circumscribed by circle 21 having radius "R." The area of a hexagon ($A_{hexagon}$) is $2.59808R^2$. The area of a circle ($A_{circle}$) having a radius "R" is $\pi R^2$. Accordingly, a regular hexagon has an area approximately 82.7% of a circumscribing circle.

In contrast, the area of a square plate, such as may be found in prior art anchors, has an area that is less than 64% of the area of a circle circumscribing the square plate.

Formulas for calculating the areas of regular polygons and conical sections, such as ellipses, may be found in the CRC Standard Mathematical Tables, CRC Press, Cleveland, OH, as well as other commonly available reference books.

The anchor is designed for use in precast concrete, whereby the lower portion of the shaft, foot and annular ring are embedded in the concrete. The head of the lifting pin component of the anchor is exposed, typically, by using a recess member aligned flush with the top of the concrete surface, as is well known to those skilled in the art. The anchor may be employed in a wide variety of precast concrete structures, including slabs, such as are used in the walls, floors and ceilings of buildings.

The anchor of the present invention may be used in precast concrete in conjunction with rebar or other steel bar, welded-wire mesh, pre-tensioned cables or post-tensioned cables, placed in proximity to the anchor.

There are, of course, many alternative embodiments and modifications of the invention, which are intended to be included in the following claims.

I claim:

1. An anchor for lifting precast concrete, comprising:
(a) a lifting pin having a shaft, a head positioned at an upper end of the shaft, and a foot positioned at a lower end of the shaft, wherein the head is smaller than the foot; and
(b) an annular ring having an opening in the center, and the annular ring overlays the foot of the pin, with the shaft extending through the opening, wherein the annular ring has an area that is at least 70% of an area of a hypothetical circle circumscribing the annular ring.

2. The anchor of claim 1, wherein the annular ring has a shape selected from the group consisting of circular, elliptical, pentagonal, hexagonal and heptagonal shapes.

3. The anchor of claim 2, wherein the annular ring has a circular or hexagonal shape.

4. The anchor of claim 1, wherein the annular ring is circular.

5. The anchor of claim 1, wherein the area of the annular ring is at least 75% of the area of the hypothetical circle.

6. The anchor of claim 1, wherein the area of the annular ring is at least 80% of the area of the hypothetical circle.

7. A precast concrete structure comprising the anchor of claim 1 with the lower end of the shaft, the foot and the annular ring embedded in the concrete structure, and with the head of the anchor exposed.

8. An anchor for lifting precast concrete, the anchor comprising:
a lifting pin comprising:
a shaft defining an upper end and a lower end;
a head forming the upper end of the shaft; and
a foot forming the lower end of the shaft,
wherein the head has a diameter that is smaller than a diameter of the foot; and
an annular ring having an elliptical shape, wherein the annular ring defines a central opening extending through the annular ring, wherein the annular ring overlays the foot of the pin to be supported by the foot of the pin with the shaft extending through the opening, and wherein the annular ring has an area that is at least 75% of an area of a hypothetical circle circumscribing the annular ring.

9. The anchor of claim 8, wherein the annular plate is welded to the foot by a spot weld or a continuous weld.

10. The anchor of claim 8, wherein the anchor comprises a metal, and wherein the anchor is provided with a protective coating.

11. The anchor of claim 8, wherein the annular ring has an area that is at least 80% of the area of the hypothetical circle.

12. The anchor of claim 8, wherein the foot has a shape in the form of a frustum of a cone.

13. The anchor of claim 8, wherein the head is cylindrical, and wherein a diameter of the opening is greater than a diameter of the head.

14. The anchor of claim 8, wherein the annular ring is configured to pass over the head, and wherein the annular ring and the head are rotated relative to one another for the annular ring to pass over the head.

15. A precast concrete structure, comprising the anchor of claim 8, with the lower end of the shaft, the foot and the annular ring embedded in the concrete structure, and with the head of the anchor exposed.

16. The precast concrete structure of claim 15, wherein the precast concrete structure further comprises a steel bar, welded-wire mesh, pre-tensioned cable, or post-tensioned cable in proximity to the anchor.

17. The anchor of claim 8, wherein the lifting pin is forged.

18. The anchor of claim 8, wherein a diameter of the head is less than a diameter of the foot.

19. The anchor of claim 8, wherein a planar extent of the annular ring is aligned perpendicular to the shaft.

20. The anchor of claim 19, wherein the foot has a frustum shape, and wherein the annular ring is welded to the foot.

* * * * *